US007884836B2

(12) United States Patent
Hussain

(10) Patent No.: US 7,884,836 B2
(45) Date of Patent: Feb. 8, 2011

(54) NOTIFYING A GRAPHICS SUBSYSTEM OF A PHYSICAL CHANGE AT A DISPLAY DEVICE

(75) Inventor: Syed Athar Hussain, Scarborough (CA)

(73) Assignee: ATI Technologies ULC, Markham, Ontario (CA)

( * ) Notice: Subject to any disclaimer, the term of this patent is extended or adjusted under 35 U.S.C. 154(b) by 790 days.

(21) Appl. No.: 11/162,140

(22) Filed: Aug. 30, 2005

(65) Prior Publication Data

US 2007/0046697 A1 Mar. 1, 2007

(51) Int. Cl.
*G09G 5/00* (2006.01)

(52) U.S. Cl. ..... 345/649; 345/3.4

(58) Field of Classification Search ..... 345/659, 345/1.1–3.4, 158, 649, 156, 204, 211, 213, 345/619, 658

See application file for complete search history.

(56) References Cited

U.S. PATENT DOCUMENTS

| | | | | |
|---|---|---|---|---|
| 5,189,404 | A * | 2/1993 | Masimo et al. | 345/659 |
| 5,329,289 | A * | 7/1994 | Sakamoto et al. | 345/659 |
| 5,973,664 | A * | 10/1999 | Badger | 345/659 |
| 6,289,466 | B1 | 9/2001 | Bayramoglu et al. | |
| 6,314,479 | B1 * | 11/2001 | Frederick et al. | 710/63 |
| 6,697,033 | B1 * | 2/2004 | Leung et al. | 345/5 |
| 7,598,948 | B1 * | 10/2009 | Priem | 345/204 |
| 2003/0025685 | A1 * | 2/2003 | Shirasaki et al. | 345/204 |
| 2003/0122781 | A1 | 7/2003 | Koo | |
| 2003/0222848 | A1 | 12/2003 | Solomon et al. | |
| 2004/0039862 | A1 * | 2/2004 | Hunt et al. | 710/304 |
| 2004/0150650 | A1 * | 8/2004 | Mendelson et al. | 345/589 |
| 2004/0201595 | A1 | 10/2004 | Manchester | |
| 2004/0218598 | A1 * | 11/2004 | Kobayashi | 370/389 |
| 2005/0225547 | A1 * | 10/2005 | Choi | 345/211 |

OTHER PUBLICATIONS

"High-Definition Multimedia Interface, Specification Version 1.1", May 20, 2004, pp. 1-206.*

* cited by examiner

*Primary Examiner*—Amare Mengistu
*Assistant Examiner*—Hong Zhou
(74) *Attorney, Agent, or Firm*—Vedder Price P.C.

(57) ABSTRACT

When a physical change (e.g. a change in screen orientation) is detected at a display device that is attached to a graphics subsystem of a host device and on which images are currently being displayed, a hot plug detect signal may be provided to the graphics subsystem. In response, the graphics subsystem may adjust its processing of images to account for the physical change (e.g. the image may be rotated). The display device may communicate data representative of the physical change to the graphics subsystem. The graphics subsystem may use this data to determine how its processing of images should be adjusted. The data may be communicated over an I2C bus regardless of whether a hot plug detect signal is provided.

8 Claims, 7 Drawing Sheets

NOTIFYING A GRAPHICS SUBSYSTEM OF A PHYSICAL CHANGE AT A DISPLAY DEVICE

FIELD OF THE INVENTION

The present invention relates to notifying a graphics subsystem of a physical change at a display device, such as a change in screen orientation of a computer monitor for example.

BACKGROUND OF THE INVENTION

Display devices which are capable of automatically orienting a displayed image to a landscape orientation or a portrait orientation based on an sensed physical orientation of the display device's screen are known. For example, U.S. Publication No. 2004/0201595 A1 discloses a self-orienting display which automatically rotates and reformats a display image in accordance with the "sensed characteristics of an object", which include the sensed orientation of a display. The publication teaches that sensing of object characteristics may be achieved by way of various types of sensors, such as mechanical, electrical, optical, acoustic or gyroscopic sensors, or combinations thereof. In other examples, U.S. Publication Nos. 2003/0222848 A1 and 2003/0122781 A1 also disclose a method, system and/or apparatus for automatically switching viewing orientations of a display in response to physical rotation of the display. The specific mechanisms for communicating sensed screen orientation to hardware or software responsible for automatically orienting a displayed image are not described in detail.

Known analog or digital display devices, such Cathode Ray Tubes (CRTs), flat panel displays such as Liquid Crystal Display (LCD) or Digital Light Processing (DLP) monitors, or plasma displays for example, are often driven by a graphics subsystem (GSS) of a host device to which the display device is connected. The host device may be a "CPU box" or "tower" of a computer for example. The graphics subsystem is a component which converts a logical representation of an 2D or 3D image stored in memory to signals that can be used by a display device to generate and display the image. A GSS may either be integrated into the motherboard of a host device or it may be a stand-alone expansion card having a dedicated processor (the dedicated processor may be referred to as a Graphics Processing Unit or GPU). Examples of commercially available of GSSs are the Radeone® X800, Radeon® X800 Pro, and Radeon® X600 cards manufactured by ATI Technologies Inc. Graphics subsystems may be referred to in the art by various terms, such as a graphics cards, video cards, video boards, video display boards, display adapters, video adapters, or graphics adapters.

In many contemporary systems, the interconnection between a GSS and display device takes the form of a cable which conforms to a known industry standard, such as a Digital Visual Interface (DVI), High Definition Multimedia Interface (HDMI), VGA, composite/S-video or component out. Alternatively, a proprietary form of interconnection could be employed. For the most part, the signals that are transmitted across the cable, which may be analog or digital depending upon the standard governing the interconnection and the type of signals supported by the display device, flow from the GSS to the display device. However communication in the reverse direction may also occur in some cases. For example, communication in the reverse direction may occur soon after a display device is connected to a host device, for purposes of sending information from the display device to the host device regarding display device characteristics.

A novel approach for notifying a graphics subsystem of a physical change at a display device would be desirable.

SUMMARY OF THE INVENTION

When a physical change (e.g. a change in screen orientation) is detected at a display device that is attached to a graphics subsystem of a host device and on which images are currently being displayed, a hot plug detect signal may be provided to the graphics subsystem. In response, the graphics subsystem may adjust its processing of images to account for the physical change (e.g. the image may be rotated). The display device may communicate data representative of the physical change to the graphics subsystem. The graphics subsystem may use this data to determine how its processing of images should be adjusted. The data may be communicated over an I2C bus regardless of whether a hot plug detect signal is provided.

In accordance with an aspect of the present invention there is provided a method comprising: upon detection of a physical change at a display device that is connected to a graphics subsystem of a host device and on which images are currently being displayed, providing a hot plug detect signal to said graphics subsystem.

In accordance with another aspect of the present invention there is provided a display device comprising: a sensor capable of detecting a physical change at said display device while images from a graphics subsystem of a host device are being displayed; and circuitry for providing a hot plug detect signal to said graphics subsystem responsive to said detecting.

In accordance with yet another aspect of the present invention there is provided a method comprising: at a graphics subsystem of a host device which is interconnected with a display device that is currently displaying images processed by said graphics subsystem: detecting a hot plug detect signal from said display device, said hot plug detect signal being indicative of a physical change at said display device; and adjusting processing of images destined for said display device to account for said physical change at said display device.

In accordance with still another aspect of the present invention there is provided a graphics subsystem of a host device, said graphics subsystem comprising: means for detecting a hot plug detect signal from a display device which is currently displaying images processed by said graphics subsystem, said hot plug detect signal being indicative of a physical change at said display device; and means for adjusting processing of images destined for display at said display device to account for said physical change at said display device.

In accordance with yet another aspect of the present invention there is provided a method comprising: upon detection of a physical change at a display device which is interconnected with a graphics subsystem of a host device by an I2C bus, transmitting data indicative of said physical change to said graphics subsystem over said I2C bus.

In accordance with still another aspect of the present invention there is provided a display device comprising: a sensor capable of detecting a physical change at said display device while images from a graphics subsystem of a host device are being displayed; and circuitry for, responsive to said detecting, transmitting data indicative of said physical change to said graphics subsystem over an I2C bus.

In accordance with yet another aspect of the present invention there is provided A graphics subsystem of a host device, said graphics subsystem comprising: circuitry for receiving data over an I2C bus from a display device which is currently displaying images processed by said graphics subsystem, said data being indicative of a physical change at said display device; and means for adjusting processing of images destined for display at said display device to account for said physical change at said display device.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In the figures which illustrate example embodiments of this invention.

DETAILED DESCRIPTION

Figure 1:
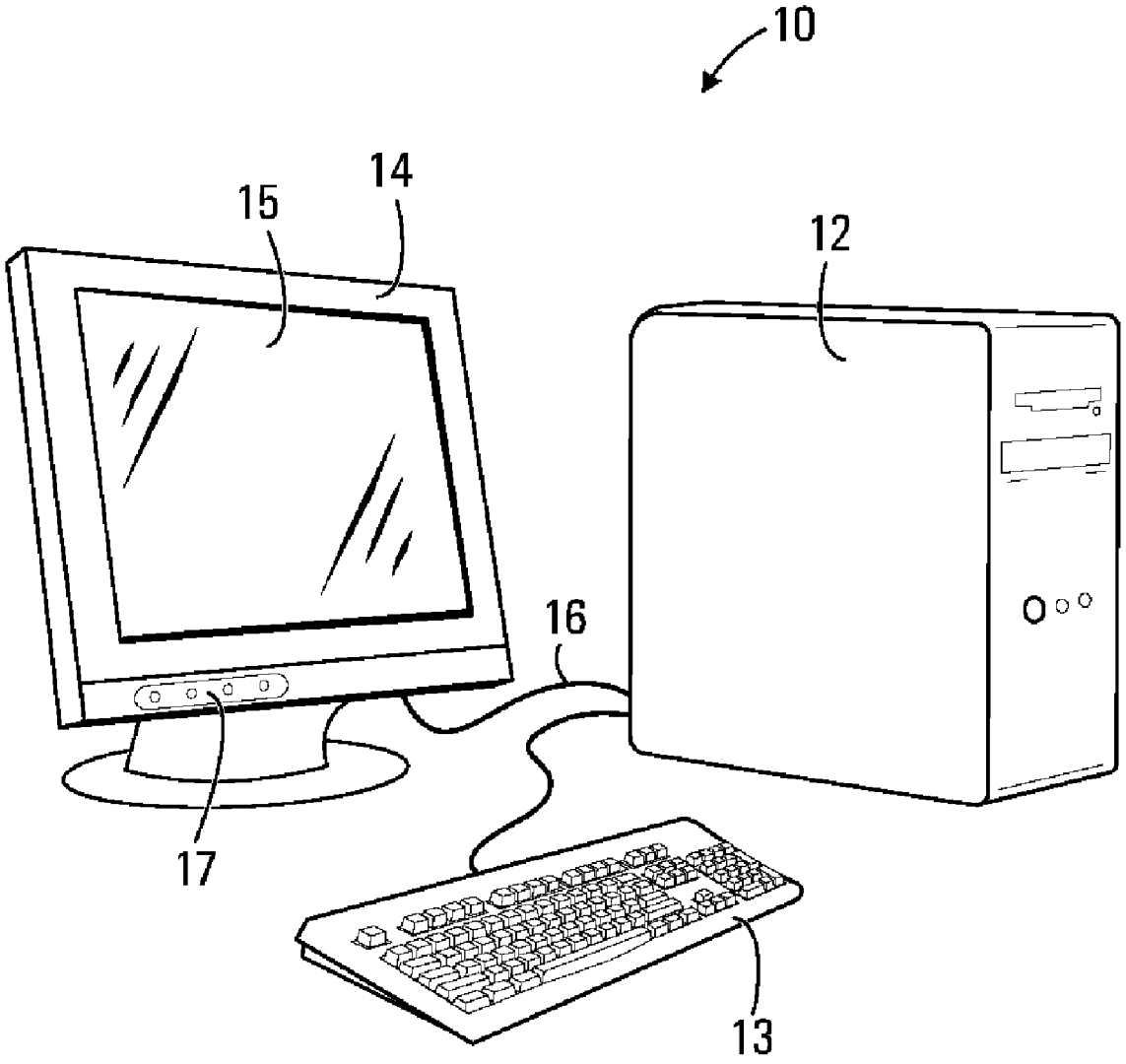
FIG. 1 is a block diagram illustrating a computing system comprising a host device and display device.

Referring to FIG. 1, a computing system 10 exemplary of an embodiment of the invention is illustrated. In the illustrated embodiment, the computing system 10 is a personal computer consisting of a CPU box 12 and a display device 14 interconnected by a connector 16.

The CPU box 12, as its name suggests, is the portion of the computer 10 which contains the main processor or CPU. The CPU box 12 includes various components other than the CPU, such as a power supply, memory, peripheral cards and cooling fan for example, none of which are illustrated. Notably, the CPU box 12 include a graphics subsystem, which is modified from a conventional GSS as will be described below. A user input mechanism 13, such as a keyboard (as illustrated in FIG. 1), mouse, trackball, touch screen, tablet or combination of such devices, is also attached CPU box 12 and permits user to control the system 10. The CPU box 12 is a form of host device.

Display device 14 is a digital display device which in the present example is a flat panel LCD display. As is conventional, the display device 14 is capable of displaying images on its screen 15 which originate from the CPU box 12, and in particular, from the graphics subsystem of box 12. The display includes a set of controls 17 on its bevel portion which may consist of a number of push buttons. The controls 17 permit a user of the system 10 to adjust certain display device viewing parameters, such as brightness, contrast, and the like, in a similar manner to the "on screen display" mechanisms which form part of many conventional displays. As will be appreciated, the mechanism by which such adjustments are effected upon manipulation of controls 17 in the present embodiment is not conventional. The display device 14 may include various other, internal components, such as a screen orientation sensor, which are not visible in FIG. 1 and will be described below.

The connector 16 is a cable which transmits digital signals representing images to be displayed from the CPU box 12 (specifically, the graphics subsystem of the CPU box 12) to the display device 14. In the present embodiment, the cable is a DVI-D or DVI-I cable which conforms to the Digital Visual Interface (DVI) specification of the Digital Display Working Group (DDWG). In accordance with the DVI specification, signals are transmitted in digital form. Also, some flow of information from the display device 14 to the CPU box 12 is supported. Standard plugs at each end of the connector 16 are inserted into sockets in the backplane of the CPU box 12 and display device 14.

In accordance with the DVI standard, the connector 16 mechanically incorporates a hot plug detect line/pin (not specifically illustrated). The signal "hot plug detect" signal carried on a hot plug detect line is conventionally used in the industry for purposes of allowing a CPU box to dynamically detect interconnection of the display device only when the device is either plugged in or when it is unplugged and while the CPU box is powered on. As will become apparent, however, the present embodiment employs the hot plug detect line for purposes of notifying the CPU box 12 of physical changes at the display device which necessitate adjustment of the manner in which images are displayed at the display device, which is not a conventional use of the hot plug detect line.

DVI connectors such as connector 16 also conform to the Display Data Channel (DDC) standard, which is known in the art. The DDC standard is promulgated by the Video Electronics Standards Association and governs communication between a display device and a graphics subsystem. The DDC standard provides a standardized approach whereby a display device can inform the GSS about its characteristics, such as maximum resolution and color depth, so as to permit the GSS to cause valid display configuration options to be presented to a user for example. Mechanically, the connector 16 incorporates three lines/pins for communicating display device characteristics, namely, data, clock and ground, in accordance with the DDC standard. The specific version of the DDC standard to which the connector 16 of the present embodiment conforms is the Enhanced Display Data Channel (E-DDC™) Standard, Version 1.1 (Mar. 24, 2004). This standard is promulgated by the Video Electronics Standards Association (www.vesa.org), and is hereby incorporated by reference hereinto.

Figure 2:
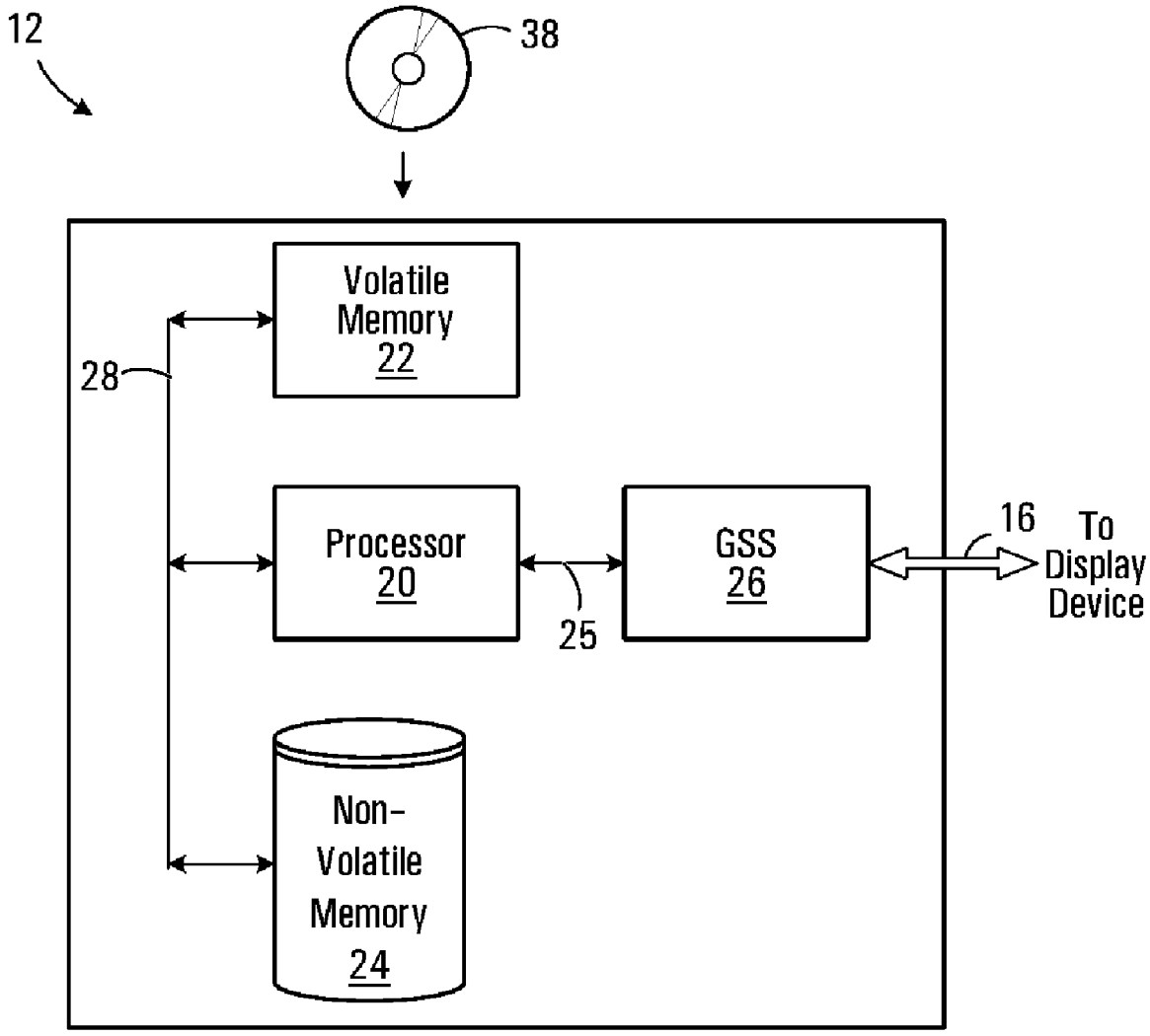
FIG. 2 is a block diagram illustrating a host device of FIG. 1 in greater detail.

FIG. 2 illustrates the CPU box 12 of FIG. 1 in greater detail. As illustrated, the CPU box 12 includes a processor 20, volatile memory 22, non-volatile memory 24 and a graphics subsystem 26.

Processor 20 is the main processor or CPU of the computing system 10 of FIG. 1. The processor 20 is conventional and may for example be a Pentium® microprocessor manufactured by Intel Corporation or an Athlon® micro-processor manufactured by Advanced Micro Devices, Inc. Other types of processors manufactured by other corporations, such as Motorola, Inc., International Business Machines Corp., or Transmeta Inc., could alternatively be employed.

Volatile memory 22 is conventional random access memory which stores executable software and data during the operation of the computing system 10. Volatile memory 22 may be a form of Dynamic Random Access Memory (DRAM) for example. The executable software stored in memory 22 includes operating system software and application software. The operating system software may be a executable code representing conventional operating system such as Windows XP, Windows 2000, Windows NT, or Linux® for example. Other operating systems, such as UNIX, Apple OS, Solaris, Sun-OS, or HP-UX, could be employed in alternative embodiments. The application software may be a conventional application, such as a word processor, spreadsheet or video game, which causes 2D or 3D images to be generated for display on display device 14.

Non-volatile memory 24 is a conventional form of non-volatile memory, such as a hard disk drive for example, which may store executable software and data when the computing system 10 (FIG. 1) is powered down.

Processor 20, volatile memory 22 and non-volatile memory 24 are interconnected by way of a system bus 28. The specific implementation of bus 28 is not central to the present description.

The graphics subsystem 26 is a hardware component which converts a logical representation of a 2D or 3D image to signals that are transmitted to and used by the display device 14 (FIG. 1) to display the image. In the present embodiment, the GSS 26 is a stand-alone expansion card, such as a Radeon® X800, Radeon® X800 Pro, or Radeon® X600 card manufactured by ATI Technologies Inc. The GSS 26 could however be integrated into a motherboard of CPU box 12 in alternative embodiments. The interconnection 25 between the main processor 20 and GSS 26 in FIG. 2 may conform to a known bus specification such as the Accelerated Graphics Port (AGP) or PCI Express™ interface specifications. The GSS 26 is described in greater detail below. It is noted that the GSS 26 serves as the point of connection for connector 16 of FIG. 1 at CPU box 12 (e.g. at the backplane of CPU box 12).

Figure 3:
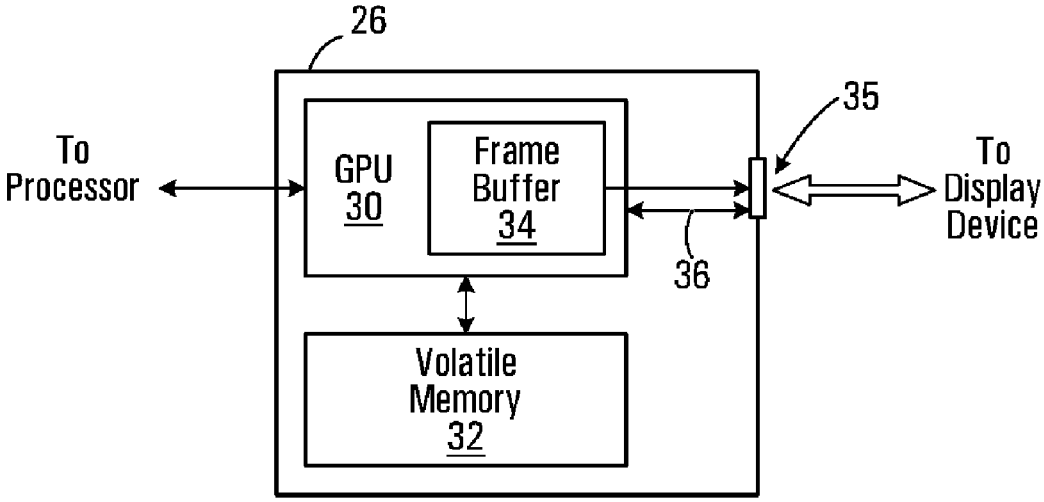
FIG. 3 is a block diagram illustrating a graphics subsystem of the host device of FIG. 2.

FIG. 3 illustrates the graphics subsystem 26 of FIG. 2 in greater detail. As illustrated, the GSS 26 includes a graphics processing unit 30, volatile memory 32, and bus 36. Other components have been omitted for clarity.

The graphics processing unit 30 is the processing engine which is responsible for converting a logical representation of an 2D or 3D image to a form which can be displayed by display device 14 of FIG. 1. The type and amount of processing that is performed by the GPU 30 depends upon the type of image to be displayed (e.g. 2D versus 3D) and the particular algorithms to be applied. In the case of 3D images, the algorithms may include complex vertex or pixel shading, anti-aliasing, and compression algorithms for example. The GPU 30 includes a framer buffer 34. Frame buffer 34 is a buffer which stores processed image data which is ready for transmission to and display by the display device 14. Its output is connected to the socket at backplane 35 to which connector 16 (FIG. 1) is connected. In alternative embodiments, the frame buffer 34 could form part of volatile memory 32 (described below).

Volatile memory 32 serves as temporary storage for image data during the image processing that is performed by GPU 30. As known to those skilled in the art, images may undergo numerous transformations during their conversion from logical to final form. Memory 32 is typically a form of RAM which supports high-speed memory access. Memory 32 is interconnected with GPU 30 in conventional manner.

Bus 36 interconnects certain pins from backplane 35 with the GPU 30. In particular, bus 36 interconnects the hot plug detect, data, ground and clock pins from the backplane 35 to the GPU 30. As will be appreciated, in the illustrated embodiment, the hot plug detect signal is used to notify the GPU 30 of a physical change at the display device 14 (FIG. 1).

The operation of the graphics subsystem 26 as described herein may be governed by machine-executable code which is loaded from a machine-readable medium 38 into volatile memory 22 (FIG. 2), such as a CD-ROM, DVD, magnetic disk or read only memory chip for example. This code may take the form of a driver, which is part of the operating system executing at CPU box 12.

Figure 4:
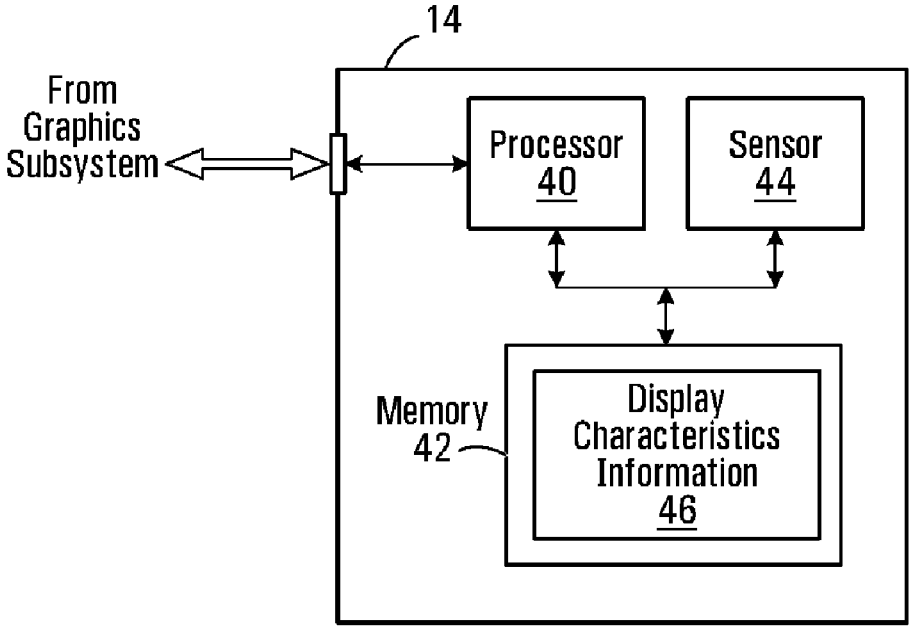
FIG. 4 is a block diagram illustrating the display device of FIG. 1 in greater detail.

FIG. 4 illustrates the display device 14 of FIG. 1 in greater detail. Display device 14 includes a processor 40, volatile memory 42 and a sensor 44, which components are conventionally interconnected. It is noted that the screen portion 15 of the display device 14 (FIG. 1) is omitted from FIG. 4 for clarity, as are certain other display device components.

Processor 40 is the engine which drives the operation of display device 14. Processor 40 is a conventional display processor whose operation has been modified in accordance with the following description for purposes of supporting notification of the graphics subsystem 26 (FIGS. 2 and 3) of physical changes at the display device 14. The processor 40 receives input from the GSS 26 via connector 16, which is connected to the display device 14, e.g. at its backplane.

Volatile memory 42 stores information 46 regarding the characteristics of display device 14. In the present embodiment, the information 46 is a data structure which conforms to the known VESA Enhanced Extended Display Identification Data (E-EDID) Standard, Release A, Revision 1 (Feb. 9, 2000), which is hereby incorporated by reference hereinto. As is known in the art, that EDID standard defines a 128-byte data structure (which may be referred to as the "EDID 1.3" data structure) containing information which permits a modern computer to know what kind of monitor is connected to it, including vendor information, maximum image size, color characteristics, factory pre-set timings, frequency range limits, and character strings for the monitor name and serial number. Accordingly, the data structure includes vendor information, maximum image size, color characteristics, factory pre-set timings, frequency range limits, and character strings for the monitor name and serial number. The information 46 additionally incorporates information regarding the current physical characteristics or conditions detected at display device 14 which are relevant to the display of images at the device. For example, information may be included regarding current screen orientation or current user settings of controls 17 of FIG. 1 (e.g. screen orientation may be implicit in the X and Y resolution in the detailed timing descriptor of the EDID data structure, assuming a standard aspect ratio such as 4:3). The inclusion of this type of information within the data structure may not be conventional, and thus may require modification of conventional display software and/or hardware. Memory 42 may also store executable code which governs operation of processor 40.

Sensor 44 is a sensor which is capable of detecting physical changes at display device 14 which are relevant to the display of images at the device 14. For example, the sensor 44 may be a mechanical, electrical or optical sensor which is capable of detecting screen orientation at display device 14. Alternatively, the sensor 44 may comprise, or may be connected to, one or more of the controls 17 on the bevel of the display 14 (FIG. 1) which are used to control certain display settings. Although the sensor 44 is illustrated in FIG. 4 as a single component, multiple sensors could be represented. Multiple sensors could for example be used for purposes of redundancy or to permit different types of physical changes to be detected. Sensors could be mechanical switches, buttons for on-screen display type adjustments such as changing brightness or contrast, or a light sensor for automatic brightness correction based on an ambient light for example. As will be appreciated, it is the signals from sensor 44 which provide the basis for the current physical display device characteristics information which forms part of information 46 in memory 42, described above.

The operation of the display device 14 as described herein may be governed by machine-executable code which is stored in a read-only memory chip for example.

Figure 5:
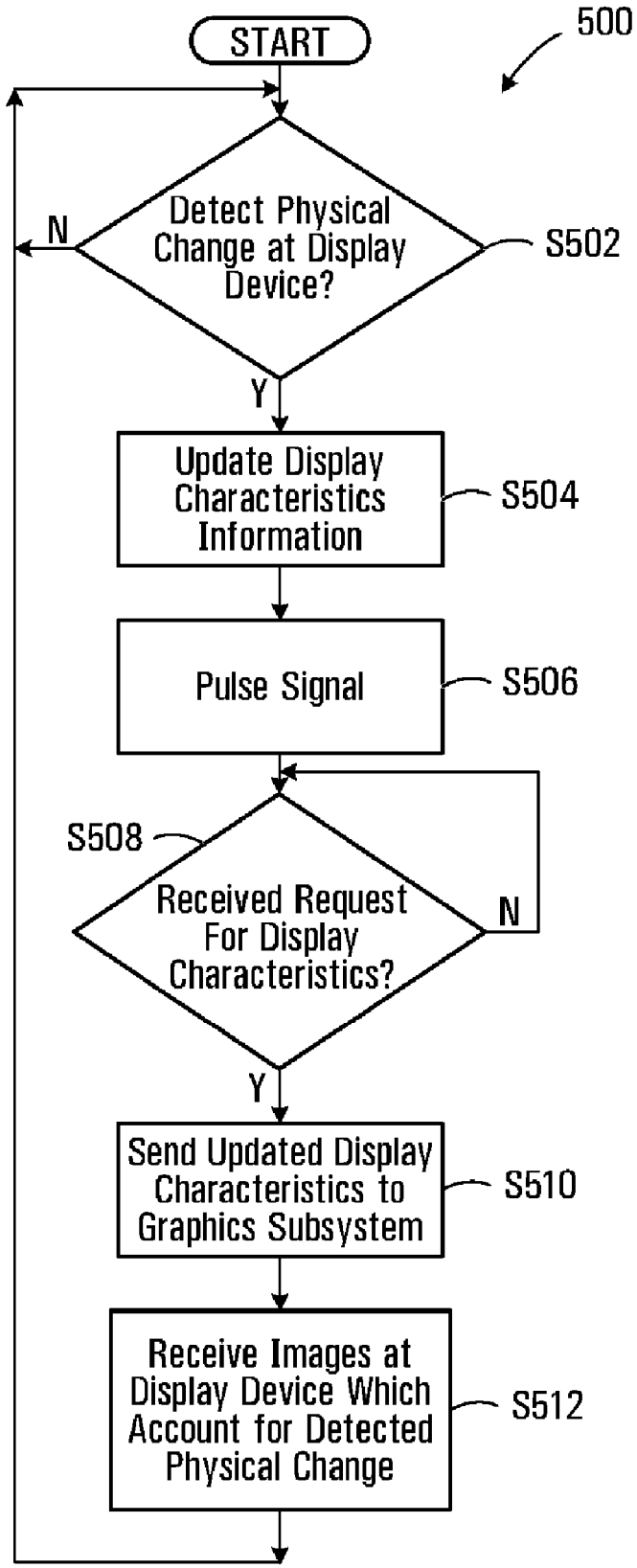
FIG. 5 is a flowchart illustrating operation at the display device of FIG. 4 for notifying the graphics subsystem of physical changes at the display device.
Figure 6:
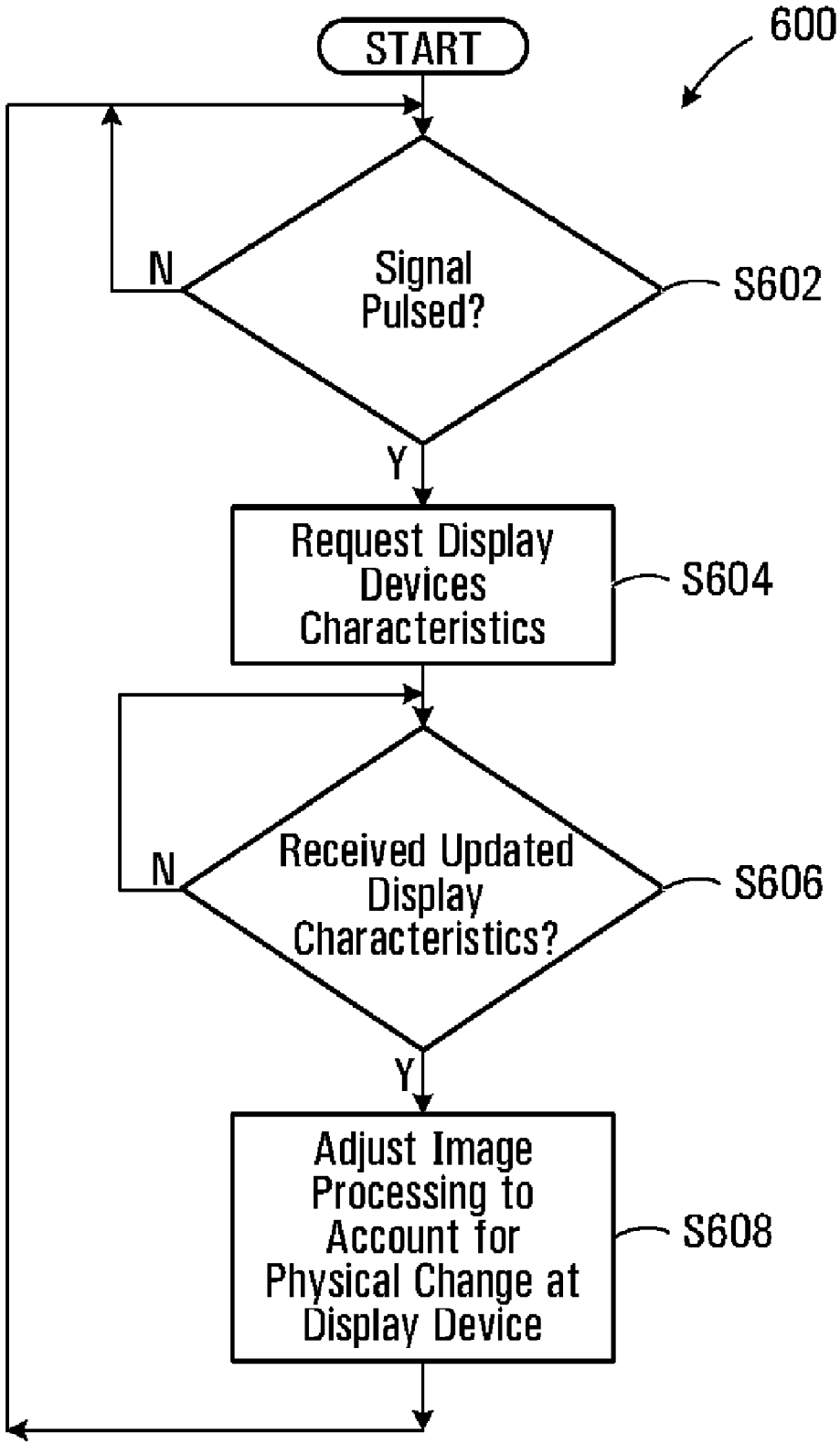
FIG. 6 is a flowchart illustrating operation at the graphics subsystem of FIG. 3 for receiving notification from the display device of physical changes at the display device.

FIGS. 5 and 6 illustrates operation 500 and 600 of the present embodiment for notifying the graphics subsystem 26 of physical changes at the display device 14. It should be appreciated that operation 500 occurs at display device 14 while operation 600 occurs at the GSS 26.

For purposes of the following description, it is presumed that the display device 14 of FIG. 1 has been connected to the CPU box 12 via connector 16 and is actively displaying images generated by the GSS 26 (FIGS. 2 and 3) on its screen 15. The physical connection of display device 14 to the CPU box 12 may have been detected at GSS 26 through a conventional adjustment of the hot plug detect signal level.

Referring to FIG. 5, initially an assessment is made as to whether sensor 44 has detected a physical change at the display device 14 which necessitates adjustment of the manner in which images are displayed by the display device 14 (S502). The assessment may be made through polling of the sensor 44 or may occur automatically via an interrupt for example.

Assuming that the sensor 44 (FIG. 4) has detected a physical change, display characteristics information 46 is then updated to reflect the current physical condition of the device 14 (S504). The physical conditions recorded in information 46 are representations of the physical conditions sensed by the sensor 44.

Thereafter, the display device 14 provides a hot plug detect signal (specifically pulses the hot plug detect signal) in order to inform the GSS that a physical change has occurred at display device 14 (S506). In order for the hot plug detect signal to be pulsed, it may be necessary for hardware and/or software at the display device 14 to be modified from conventional operation in which the hot plug detect signal is driven solely for purposes of notifying the CPU box 12 of display device connection for dynamic display detection while the CPU box 12 is powered on. The nature of the hardware and/or software modifications that are necessary will be apparent to a person skilled in the art. For example, a software-controlled counter could be used to set the duration of the pulse. Alternatively, the pulse could be generated entirely by hardware.

It will be appreciated that S504 and S506 may occur in reverse order.

Turning FIG. 6, the pulsing of the hot plug detect signal by the display device 14 is detected at the GSS 26 (S602). At this stage, the pulsing may not be distinguishable from a conventional hot plug detect event, such as unplugging (i.e. disconnect) of the display device. Upon detection of the signal pulse, the GSS 26 generates an interrupt which is detected at the processor 20 of the host device (FIG. 2). When the interrupt is handled, the operating system of the host device directs the GSS 26 to send a request to the display device 14 for display device characteristics information (S604), which information has been updated to indicate the physical change which occurred at the display device 14, as described above. The request may be similar to a request for display characteristics (e.g. EDID) that is conventionally performed upon initial connection of the display device 14 to the CPU box 12, according to the DDC2B standard for example.

Referring back to FIG. 5, the request from GSS 26 is received at the display device 14 (S508) and, responsive to that request the display device 14 sends the updated display characteristics information 46 (FIG. 4), i.e. the updated EDID information, to the GSS 26 (S510).

Back at the GSS 26 (FIG. 6), upon receipt of the updated display characteristics (S606), the image processing performed at the GSS 26 is adjusted to account for the physical condition which is reflected in the newly-received, updated display characteristics. For example, if the display characteristics evidence a screen rotation of 90 degrees, the image processing at the GSS 26 is adjusted so that the generated images are similarly rotated by 90 degrees, so that the displayed images will appear right-side up on the screen 15 (FIG. 1). Alternatively, if the display characteristics evidence a user adjustment of image contrast, brightness, or the like through manipulation of the controls 17 of the display device 14, the image processing at the GSS 26 is modified appropriately to effect the requested adjustment. In the latter case, a benefit of such operation is that hardware or circuitry for making on-screen display adjustments such as changing brightness, contrast or colour temperature need not be physically resident within the display device itself, as is the case for most conventional monitors, since the GSS 26 is used for this purpose. As a result, display device complexity and cost may be reduced. The adjustment in image processing may be achieved through execution of software stored in volatile memory 22.

Referring once again to FIG. 5, images which have been generated so as to account for the changed physical condition are received (S512) and displayed. This continues until another physical change is detected at the display device 14, in which case operation 500 of FIG. 5 and operation 600 of FIG. 6 are repeated.

As will be appreciated by those skilled in the art, modifications to the above-described embodiment can be made without departing from the essence of the invention.

For example, while the described embodiment illustrates carriage of the hot plug detect signal by a DVI connector, it should be appreciated that any other connector having a hot plug detect pin (line), such as an HDMI connector, could be used to carry the hot plug detect signal.

The adjustment of the hot plug detect signal level need not necessarily take the form of pulsing of the signal. Any adjustment of the signal level which is capable of conveying an indication of a physical change at the display device could be employed.

In some embodiments, the hot plug detect signal level adjustment that is made to indicate the occurrence of a physical change at the display device could be made to be distinguishable from the hot plug detect signal level adjustment that is made to indicate a display device connect/disconnect event, so that the graphics subsystem would be able to distinguish between the two types of events based on the nature of the level adjustment alone. Moreover, the manner in which the hot plug detect signal is modified could be used to communicate the nature of the physical change at the display device, so as to make unnecessary any separate transmission of data (such as an EDID data structure) for purposes of indicating the nature of the change. For example, pulsing twice in rapid succession could be used to communicate a screen orientation change. Moreover the duration of the toggles could be used to communicate information (e.g. a degree of rotation).

As well, the hot plug detect signal whose level is adjusted in order to notify the GSS of a physical change need not be the same hot plug detect signal as is employed under the DVI standard. Other forms of hot plug detect signal which may be used to facilitate dynamic display device detection under different standards or in proprietary systems could alternatively be employed.

Alternatively, the signal is not necessarily sent over the hot plug detect pin. For example, in cases where a connector lacks a hot plug detect pin, a reserved pin could be used to carry a signal. A VGA connector is one example of a connector which lacks a hot plug detect pin but which has a reserved pin which could be used to carry a pulsed signal.

In some embodiments, the display device 14 may send data indicative of the nature of the physical change to the graphics subsystem 26, rather than pulsing a signal to effectively invite the graphics subsystem 26 to request that data. For example, this may be done in cases where the interconnection between the graphics subsystem 26 of CPU box 12 and the display device 14 includes an I2C bus. This bus is defined in the document The I2C Bus Specification Version 2.1, January 2000, document order number 9390 393 4011, which is known in the art and is hereby incorporated by reference hereinto. The I2C bus is a simple, bi-directional two-wire bus for efficient communication between integrated circuits. The I2C bus governs how data is communicated between integrated circuits, as opposed to what information is communicated. DVI-I connectors, HDMI connectors, and VGA connectors are all examples of connectors incorporating an I2C bus.

The I2C bus allows interconnected integrated circuits to be defined as master or slave devices. Master devices are defined to be devices which initiate transfers, generate clock signals used for data synchronization between a master and a slave, and terminate transfers. Slave devices are devices addressed by a master. The master and slave modes are described in The I2C Bus Specification Version 2.1, referenced above.

In a conventional interconnection of a graphics subsystem and display device incorporating the I2C bus, the graphics subsystem acts as the master and the display device acts as its slave, since the flow of data between the two devices is usually from the GSS to the display device (e.g. upon user modification of display settings via a control panel utility). In an alternative embodiment, however, the display device could, in addition to acting as a slave for conventional transactions, also act as a master for transactions pertaining to automatic display device change notification. Conversely, the graphics subsystem could, in addition to acting as a master for conventional transactions, also act as a slave for transactions pertaining to automatic display device change notification.

Figure 7:
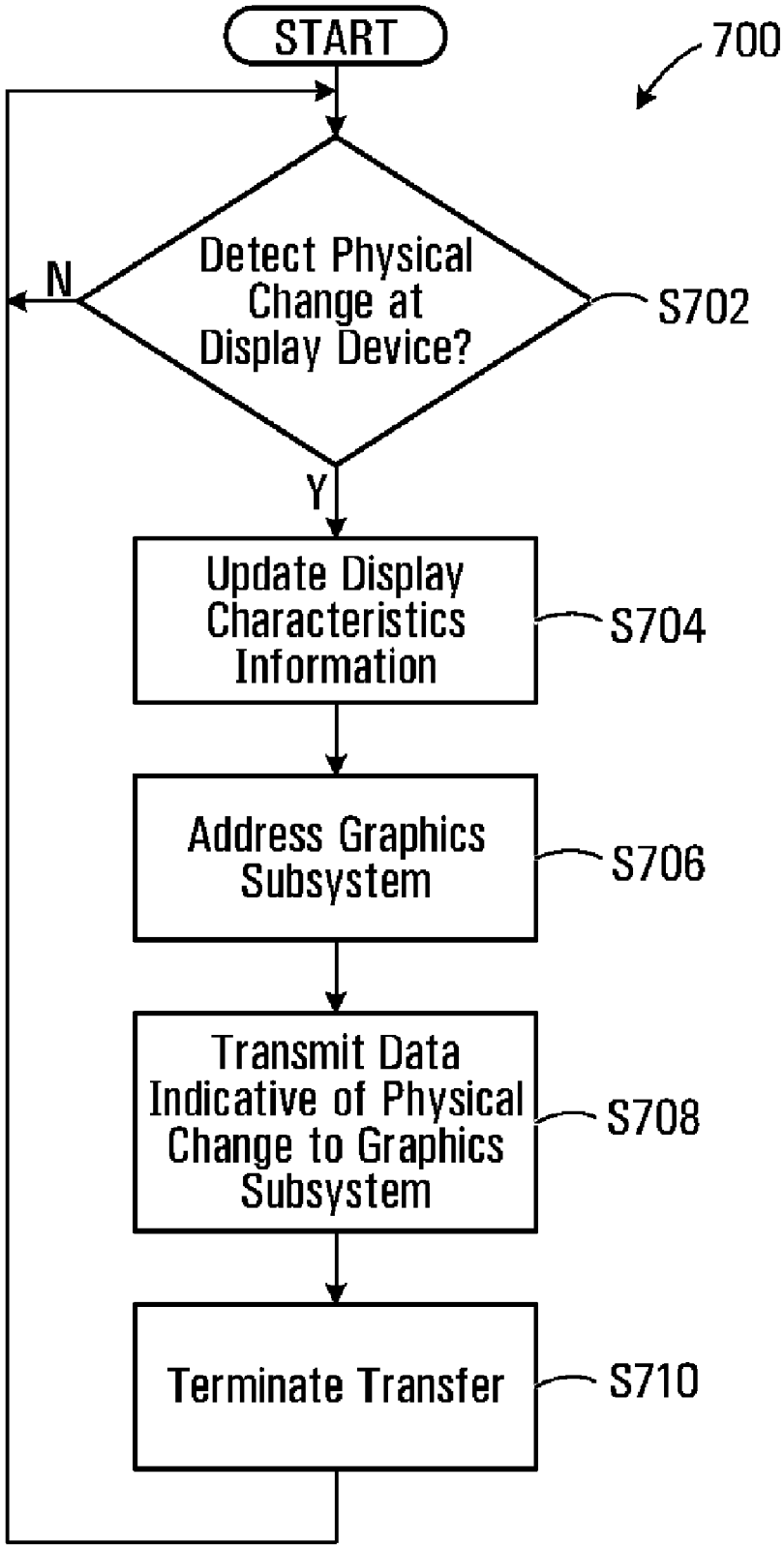
FIG. 7 is a flowchart illustrating operation at the display device of an alternative embodiment for notifying the graphics subsystem of physical changes at the display device.
Figure 8:
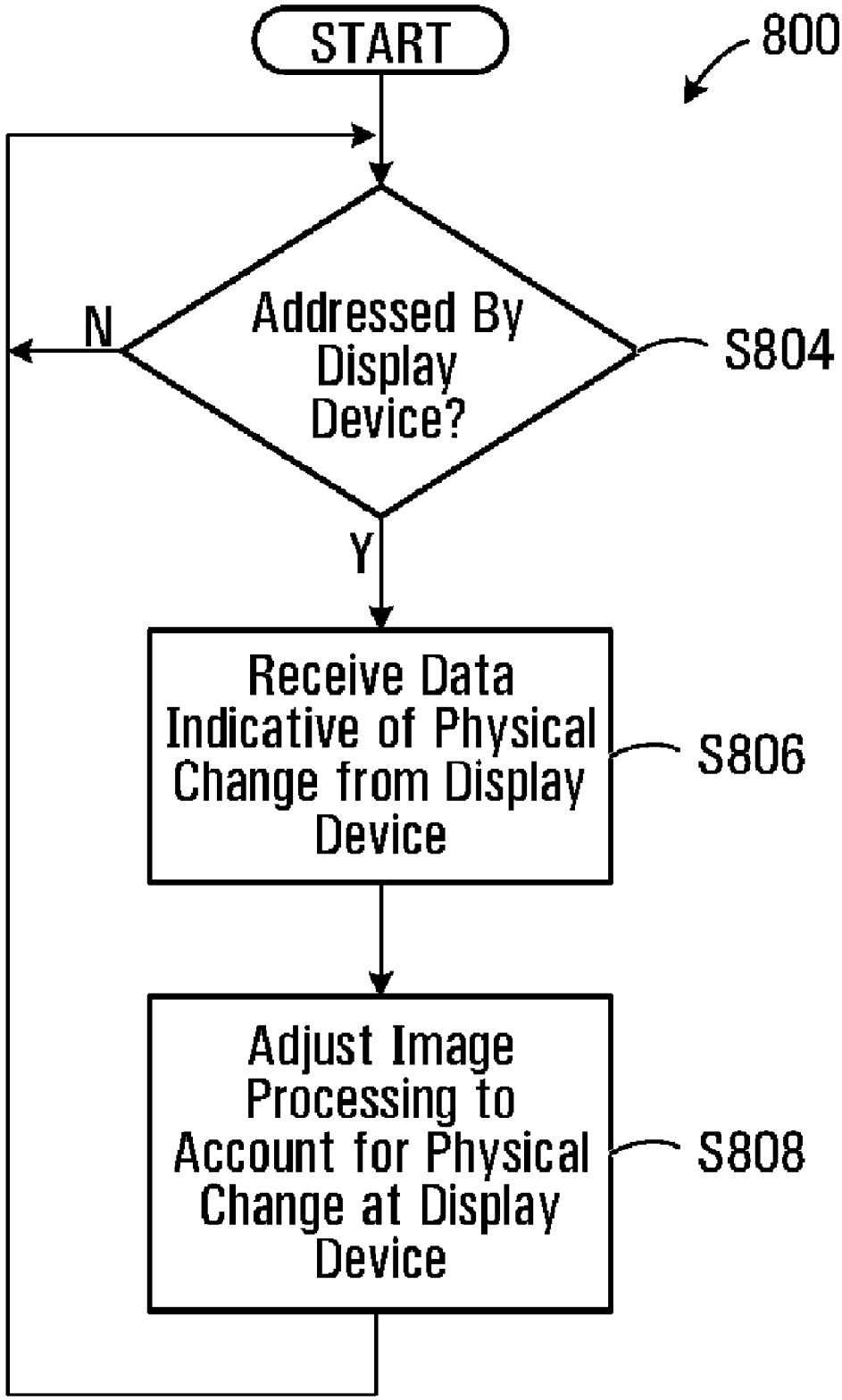
FIG. 8 is a flowchart illustrating operation at the graphics subsystem of an alternative embodiment for receiving notification from the display device of physical changes at the display device.

Operation of such an alternative embodiment is illustrated in FIGS. 7 and 8. Operation 700 of FIG. 7 occurs at display device 14 while operation 800 of FIG. 8 occurs at graphics subsystem 26.

Referring to FIG. 7, initially an assessment is made as to whether sensor 44 has detected a physical change at the display device 14 which necessitates adjustment of the manner in which images are displayed by the display device 14 (S702). As before, the assessment may be made through polling of the sensor 44 (FIG. 4) or may occur automatically via an interrupt. If sensor 44 has detected a physical change, display characteristics information 46 is updated to reflect the current physical condition of the device 14 (S704). Thereafter, the graphics subsystem 26 is addressed (S706), data indicative of the physical change is transmitted to the GSS 26 (S708), and the transfer is terminated (S710), in accordance with the I2C bus standard.

Referring to FIG. 8, after the GSS 26 has been addressed by the display device 14 (S804), the data transmitted by the display device 14 is received at the GSS 26 (S806), and image processing is adjusted to account for the relevant display device physical change (S808).

Operation 700 and 800 may be repeated for each physical change detected at the display device 14.

If at any time a user of the computing system 10 wishes to configure display device characteristics manually in a conventional manner, the user may do so. This may for example entail execution of a utility through a "control panel" or similar construct of the operating system of computing system 10 and adjusting the desired display characteristics by manipulating graphical user interface controls displayed on the screen 15 of display device 14. When this is done, the GSS 26 may communicate with the display device 14 as described in the DDC2B standard, wherein the GSS 26 conventionally acts as the master of the I2C bus and the display device 14 acts as the slave.

In a further alternative, while the described embodiment illustrates use of a DVI connector between the display device and the graphics subsystem, another suitable connector could be employed. The connector could support analog video signals, digital video signals, or a combination of the two, depending on such factors as whether the display device is an analog or digital device for example. Moreover, a wireless connection could be employed between the graphics subsystem and display device.

Other modifications will be apparent to those skilled in the art and, therefore, the invention is defined in the claims.

What is claimed is:

1. A method comprising:

upon detection of a physical change at a display device that is connected to a graphics subsystem of a host device and on which images are currently being displayed, said physical change being a changed screen orientation of said display device, providing a hot plug detect signal comprising a plurality of toggles of a hot plug detect signal level to said graphics subsystem, wherein a duration of said toggles indicates a degree of rotation of said screen.

2. The method of claim 1 wherein said images are from said graphics subsystem.

3. A display device comprising:

a sensor capable of detecting a physical change at said display device while images from a graphics subsystem of a host device are being displayed, said physical change being a changed screen orientation of said display device; and circuitry for providing a hot plug detect signal comprising a plurality of toggles of a hot plug detect signal level to said graphics subsystem responsive to said detecting, wherein a duration of said toggles indicates a degree of rotation of said screen.

4. A method comprising:

at a graphics subsystem of a host device which is interconnected with a display device that is currently displaying images processed by said graphics subsystem:

detecting an unsolicited hot plug detect signal from said display device, said hot plug detect signal comprising a plurality of toggles of a hot plug detect signal level, said plurality of toggles of said hot plug detect signal level being indicative of a physical change at said display device, said physical change being a changed screen orientation of said display device, wherein a duration of said toggles indicates a degree of rotation of said screen; and adjusting processing of images destined for said display device to account for said changed screen orientation at said display device.

5. A graphics subsystem of a host device, said graphics subsystem comprising a processor and being operable to:

detect an unsolicited hot plug detect signal from a display device which is currently displaying images processed by said graphics subsystem, said hot plug detect signal comprising a plurality of toggles of a hot plug detect signal level, said plurality of toggles of said hot plug detect signal level being indicative of a physical change at said display device, said physical change being a changed screen orientation of said display device, wherein a duration of said toggles indicates a degree of rotation of said screen; and adjust processing of images destined for display at said display device to account for said changed screen orientation at said display device.

6. A method comprising:

upon detection of a physical change at a display device which is interconnected with, and receiving images from, a graphics subsystem of a host device by an Inter-Integrated Circuit ($I^2C$) bus, said physical change being a changed screen orientation of said display device, transmitting data indicative of said changed screen orientation to said graphics subsystem over said $I^2C$ bus, wherein said display device is configured to operate in both of a master mode and a slave mode, said display device, when in said master mode, being capable of initiating a transfer with said graphics subsystem, generating clock signals for data synchronization with said graphics subsystem, and terminating said transfer with said graphics subsystem, said display device, when in said slave mode, being capable of being addressed over said $I^2C$ bus by said graphics subsystem, wherein said transmitting of data is unsolicited by said graphics subsystem and occurs when said display device is in said master mode and wherein said receiving of images occurs when said display device is in said slave mode, and wherein said transmitted data is used by the graphics subsystem for adjusting image processing to account for the changed screen orientation.

7. A display device comprising:

a sensor capable of detecting a physical change at said display device while images received from a graphics subsystem of a host device are being displayed, said physical change being a changed screen orientation of said display device; and circuitry for, responsive to said detecting, transmitting data indicative of said changed screen orientation to said graphics subsystem over an Inter-Integrated Circuit ($I^2C$) bus, wherein said display device is configured to operate in both of a master mode and a slave mode, said display device, when in said master mode, being capable of initiating a transfer with said graphics subsystem, generating clock signals for data synchronization with said graphics subsystem, and terminating said transfer with said graphics subsystem, said display device, when in said slave mode, being capable of being addressed over said $I^2C$ bus by said graphics subsystem, wherein said transmitting of data occurs is unsolicited by said graphics subsystem and when said display device is in said master mode and wherein said images are received at said display device when the display device is in said slave mode, and wherein said transmitted data is for use by the graphics subsystem for adjusting image processing to account for the changed screen orientation.

8. A host device comprising:

a processor;

a graphics subsystem comprising circuitry for receiving data over an Inter-Integrated Circuit ($I^2C$) bus from a display device which is currently displaying images processed by said graphics subsystem, said data being indicative of a physical change at said display device, said physical change being a changed screen orientation of said display device; and memory storing software that, when executed by said processor, adjusts processing of images destined for display at said display device to account for said changed screen orientation at said display device, wherein said graphics subsystem is configured to operate in both of a master mode and a slave mode, said graphics subsystem, when in said master mode, being capable of initiating a transfer with said display device, generating clock signals for data synchronization with said display device, and terminating said transfer with said display device, said graphics subsystem, when in said slave mode, being capable of being addressed over said $I^2C$ bus by said display device, wherein said receiving of data is unsolicited by said graphics subsystem and occurs when said graphics subsystem is in said slave mode and wherein said processed images are output by said graphics subsystem when said graphics subsystem is in said master mode, and wherein said received data is used by the graphics subsystem for adjusting image processing to account for the changed screen orientation.

* * * * *